US010507963B2

(12) United States Patent
Lembke et al.

(10) Patent No.: US 10,507,963 B2
(45) Date of Patent: Dec. 17, 2019

(54) RESEALABLE OPENING DEVICE AND PACKAGE COMPRISING SUCH AN OPENING DEVICE

(71) Applicant: ECOLEAN AB, Helsingborg (SE)

(72) Inventors: Mikael Lembke, Helsingborg (SE); Lars Rodman, Bjärred (SE); Jonas Fransson, Helsingborg (SE)

(73) Assignee: ECOLEAN AB, Helsingborg (SE)

( * ) Notice: Subject to any disclaimer, the term of this patent is extended or adjusted under 35 U.S.C. 154(b) by 0 days.

(21) Appl. No.: 16/085,059

(22) PCT Filed: Feb. 20, 2017

(86) PCT No.: PCT/EP2017/053759

§ 371 (c)(1),
(2) Date: Sep. 14, 2018

(87) PCT Pub. No.: WO2017/157613

PCT Pub. Date: Sep. 21, 2017

(65) Prior Publication Data

US 2019/0071232 A1 Mar. 7, 2019

(30) Foreign Application Priority Data

Mar. 16, 2016 (EP) ..... 16160688

(51) Int. Cl.
*B65D 75/58* (2006.01)
*B65D 75/00* (2006.01)
*B65D 75/56* (2006.01)

(52) U.S. Cl.
CPC ..... *B65D 75/5822* (2013.01); *B65D 75/008* (2013.01); *B65D 75/563* (2013.01); *B65D 75/5816* (2013.01); *B65D 2575/586* (2013.01)

(58) Field of Classification Search
CPC ..... B65D 75/5822; B65D 75/008; B65D 75/563; B65D 75/5816; B65D 2575/586;

(Continued)

(56) References Cited

U.S. PATENT DOCUMENTS

D760,079 S * 6/2016 Rodman ..... D9/443
2004/0208399 A1* 10/2004 Linneweil ..... B65D 31/10 383/68
2004/0208400 A1* 10/2004 Linneweil ..... B65D 31/10 383/68
2008/0044115 A1* 2/2008 Ichikawa ..... B65D 33/2533 383/204

(Continued)

FOREIGN PATENT DOCUMENTS

CH 701361 A1 12/2010
EP 1997745 A1 12/2008

(Continued)

OTHER PUBLICATIONS

International Search Report from International Application No. PCT/EP2017/053759 dated Mar. 17, 2017.

*Primary Examiner* — Benjamin R Shaw
(74) *Attorney, Agent, or Firm* — Brundidge & Stanger, P.C.

(57) ABSTRACT

A resealable opening device for a flexible package (21) of collapsible type having a compartment defined by flexible walls (24), comprising a thin-walled body (2) having a back surface (3) attachable on one of the flexible walls (24) of the package (21) in a dispensing portion (23) of the package, a first hinge joint (5) extending in a first direction (P1) and connecting a first section (6) of the body (2) with a second section (7) of the body (2), the thin-wall body (2) being intended to be arranged such that the first hinge joint (5) is arranged transversely to a dispensing direction (P4) of the package, and a second hinge joint (8) extending in a second direction (P2) crossing the first hinge joint (5), wherein a locking member (14) is arranged for locking the first section (6) to the second section (7) when the first and second sections (6, 7) are folded towards each other about the first (Continued)

hinge joint (5). The thin-walled body (2) is further provided with a third hinge joint (9) extending in a third direction (P3) crossing the first hinge joint (5) and arranged at a distance from the second hinge joint (8). The thin-walled body is adaptable to an outwardly bulging shape change of the flexible wall (24) on which the device is intended to be attached. The invention also relates to a package provided with such a resealable opening device.

8 Claims, 5 Drawing Sheets

(58) Field of Classification Search
CPC .... B65D 33/16; B65D 33/25; B65D 33/1683; B65D 33/1675; B65D 33/1658
USPC ..... 222/531
See application file for complete search history.

(56) References Cited

U.S. PATENT DOCUMENTS

| | | | | |
|---|---|---|---|---|
| 2009/0134185 | A1* | 5/2009 | Kawakami | B65D 75/5822 222/107 |
| 2010/0158416 | A1* | 6/2010 | Ichikawa | B65D 33/2533 383/42 |
| 2014/0003744 | A1* | 1/2014 | Jonsson | B65D 33/1675 383/42 |
| 2016/0250817 | A1* | 9/2016 | Fransson | B31B 50/00 493/213 |
| 2017/0129679 | A1* | 5/2017 | Persson | B65D 75/5805 |
| 2018/0319562 | A1* | 11/2018 | Rodman | B65D 75/008 |

FOREIGN PATENT DOCUMENTS

| | | | |
|---|---|---|---|
| WO | 2012062806 | A1 | 5/2012 |
| WO | 2015192999 | A1 | 12/2015 |

* cited by examiner

RESEALABLE OPENING DEVICE AND PACKAGE COMPRISING SUCH AN OPENING DEVICE

FIELD OF THE INVENTION

The present invention relates to a resealable opening device for a flexible package and to a package comprising such a resealable opening device. More specifically, the resealable opening device comprises a thin-walled body having a back surface attachable to a wall of the flexible package in a dispensing portion thereof.

BACKGROUND ART

There are a large number of different goods which are packed in flexible containers or packages produced from a film material.

The packages may house particulate goods, such as crisps, peanuts or coffee beans, and in this case often have a so-called pillow shape.

Alternatively, the packages may house liquid goods, such as milk, water or wine, and are here normally of the so-called stand-up pouch type, also referred to as collapsible-type packages. Packages of the stand-up pouch type may, of course, also be used for particulate goods.

Packages or containers of this flexible type are normally opened by the removal of an end tab or corner portion. Alternatively, they can be opened by a user pulling apart the side walls of the package in order thereby to break an upper transverse seal of the package.

Common to these flexible packages is that there is often a need to be able to reseal the package once it has been opened. By resealing the package, the risk of accidental spillage of the content of the package is reduced, whilst the resealing often has a positive effect on the shelf life of the content.

This resealing may be realized with the aid of clips, screw caps, rubber bands, tapes, etc. It has nevertheless proved difficult to provide an opening device which is cheap, reliable and user-friendly.

An opening device addressing these issues is known from WO21012/062806. The opening device disclosed therein comprises a thin-walled body which is to be attached on one side wall of a flexible package, in a dispensing portion thereof. According to an embodiment disclosed in WO21012/062806, the dispensing portion is arranged in an upper corner of the package, and the dispensing portion comprises a end tab which is removable by cutting, tearing or the like, in order to form an opening through which the contents of the package may be dispensed.

The thin-walled body comprises a first hinge joint and by folding the thin-walled body about this first hinge joint, the opening of the package may be resealed by means of a locking member. The thin walled body further comprises second hinge joint extending in a direction crossing the first hinge joint, and by folding the thin-walled body about the second hinge joint, the opening may be opened up.

Filled packages provided with resealable opening devices of the type disclosed above are often distributed form the filling facility, such as a dairy, to a sales facility, such as a super market, in boxes of crates. During such distribution, the packages are often placed horizontally, i.e. lying down, in the boxes or crates. During such handling, there might be a risk for the resealable opening device to come loose from the package.

SUMMARY OF THE INVENTION

In view of that stated above, the object of the present invention is to provide an improved resealable opening device in the form of a thin-walled body for a flexible package.

It is also an object to provide a flexible package comprising such an improved resealable opening device.

It is further an object of the present invention to provide such an improved resealable opening device which is less prone to become loose during handling such as distribution.

To achieve at least one of the above objects and also other objects that will be evident from the following description, a resealable opening device having the features defined by the following claims are provided according to the present invention. Preferred embodiments of the resealable opening device and the flexible package will be evident from the dependent claims.

More specifically, there is provided according to the present invention a a resealable opening device for a flexible package of collapsible type having a compartment defined by flexible walls, comprising a thin-walled body having a back surface attachable on one of the flexible walls of the package in a dispensing portion of the package, a first hinge joint extending in a first direction and connecting a first section of the thin-walled body with a second section of the thin-walled body, the thin-wall body being intended to be arranged such that the first hinge joint is arranged transversely to a dispensing direction of the package, and a second hinge joint extending in a second direction crossing the first hinge joint. A locking member is arranged for locking the first section to the second section when the first and second sections are folded towards each other about the first hinge joint. The thin-walled body is provided with a third hinge joint extending in a third direction crossing the first hinge joint and arranged at a distance from the second hinge joint, wherein the thin-walled body comprises a first end region including a first portion of the first section and a first portion of the second section, an intermediate region including a second portion of the first section and a second portion of the second section, and a second end region including a third portion of the first section and a third portion of the second section. The second hinge joint is arranged between the first end region and the intermediate region; and the third hinge joint is arranged between the second end region and the intermediate region, wherein the first end region, the intermediate region and the second end region are foldable relative to each other by means of the second and third hinge joints such that the thin-walled body is adaptable to an outwardly bulging shape change of the flexible wall on which the device is intended to be attached.

Hereby an improved resealable opening device for a flexible package is provided. The provision of two hinge joints extending across the first hinge joint such that the thin-walled body may adapt to an outwardly bulging shape change of the flexible wall upon which the device is intended to be attached, has the effect of a stress relief making the opening device less prone to come loose for example during distribution of packages.

According to one embodiment of the resealable opening device, the second hinge joint and the third hinge joint may extend in a non-parallel manner giving the intermediate region of the thin-walled body a form of a truncated triangle. Hereby an opening device is provided which may efficiently adapt to an outwardly bulging shape change of the flexible wall of a tapering dispensing portion of the flexible package.

A package provided with a pouring spout in an upper corner may comprise such a tapering dispensing portion.

According to another embodiment of the resealable opening device, the second and third hinge joint may each be provided as a v-shaped groove formed in a front surface of the thin-walled body. Hereby a controlled folding of the hinge joints may be achieved when the opening device is maneuvered to a dispensing position. Such a maneuvering may be achieved by manually manipulating the opening device, by performing a pouring motion provided with the inventive opening device, or by placing such a package lying down such that the head space of the package is filled by the contents of the package.

According to yet another embodiment, the second and third hinge joint each may extend along the second and third direction, respectively, with an interruption when crossing the first hinge joint. Hereby, the integrity of the first hinge joint may be maintained in order to achieve a more reliable seal in the sealing position of the opening device.

According to yet another embodiment, the first hinge joint may be provided as a w-shaped groove formed in the back surface of the thin-walled body. Hereby a controlled folding may be achieved when the opening device is maneuvered to its sealing position while a ridge is formed ensuring a reliable seal.

According to yet another embodiment, the locking member may comprise a male element arranged on the first section of the thin-walled body and a female element arranged on the second section of the thin-walled body. Hereby a simple and reliable locking member is achieved. The locking member may be formed integrally with the thin-walled body.

The thin-walled body of the resealable opening device may be made of PET.

According to another aspect of the present invention, a flexible package is provided having a dispensing portion defined by two flexible side walls, comprising a resealable opening device according of the type described above disposed on one of the side walls in the dispensing portion adjacent to an opening, formed upon initial opening of the package, for opening and closing thereof, wherein the first hinge joint extends in parallel with the opening.

The advantages which have been specified above with reference to the inventive resealable opening device are in relevant parts also applicable to the inventive flexible package provided with such an opening device.

According to an embodiment of the flexible package, the second hinge joint and the third hinge joint may extend in a non-parallel manner giving the intermediate region of the thin-walled body a form of a truncated triangle, a top of which being arranged in proximity to the opening.

Generally, all terms used in the claims are to be interpreted according to their ordinary meaning in the technical field, unless explicitly defined otherwise herein. All references to "a/an/the [element, device, component, means, step, etc]" are to be interpreted openly as referring to at least one instance of said element, device, component, means, step, etc., unless explicitly stated otherwise. The steps of any method disclosed herein do not have to be performed in the exact order disclosed, unless explicitly stated.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, where the same reference numerals will be used for similar elements, wherein.

DESCRIPTION OF EMBODIMENTS

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Figure 1:
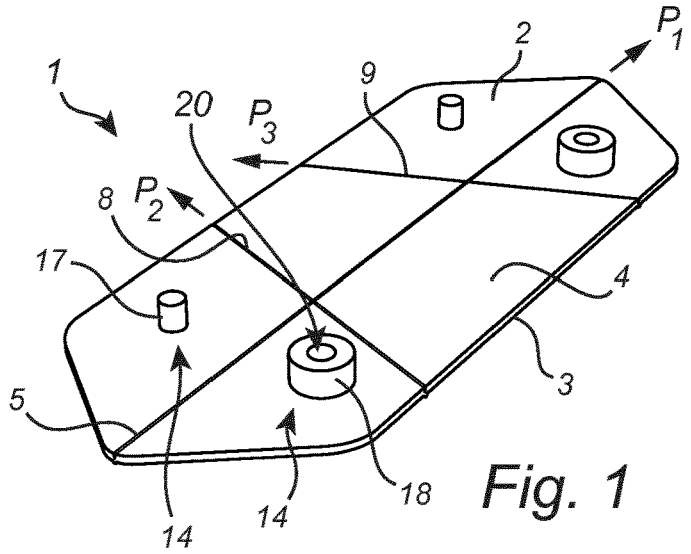
FIG. 1 is a perspective view illustrating an embodiment of a resealable opening device in accordance with the present invention.

FIG. 1, to which reference now is made, discloses a resealable opening device 1 for a flexible package of collapsible type in accordance with an embodiment of the present invention. The resealable opening device 1 is shown in a state representing a basic position.

The resealable opening device 1 comprises a thin-walled body 2 having a back surface 3 and a front surface 4.

The thin-walled body 2 may be made of a plastic material such as PET and have a thickness within the range of 0.1-0.7 mm.

The back surface 3 of the thin-walled body is attachable on a flexible wall of the package in a dispensing portion thereof. An adhesive may be provided on the back surface 3 of the thin-walled body 2. The adhesive may be of the type that is activated by means of heating.

Figure 2:
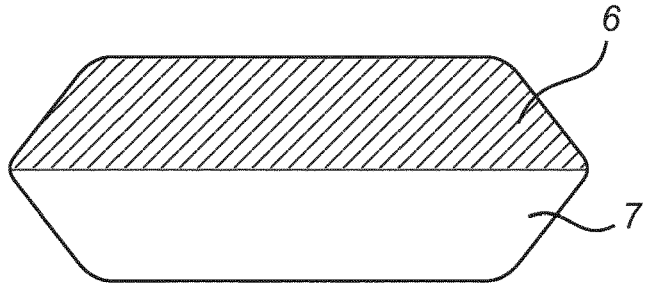
FIG. 2 is a schematic plan view illustrating a first and second section of the opening device shown in FIG. 1.

The thin-walled body 2 comprises a first hinge joint 5 extending in a first direction P1 and connecting a first section 6 of the body 2 with a second section 7 of the body 2. The first and second sections 6, 7 of the body 2 are schematically shown in FIG. 2, to which reference now also is made.

The first hinge joint 5 may be provided as a w-shaped groove formed in the back surface 3 of the thin-walled body 2. Alternatively, the first hinge joint may be provided as a u- or v-shaped groove.

The thin-walled body 2 further comprises a second and a third hinge joint 8, 9.

The second hinge joint 8 extend in a second direction P2 crossing the first hinge joint 5, and the third hinge joint 9 extend in a third direction P3 crossing the first hinge joint 5. A shown in the figure, the third hinge joint 9 is arranged at a distance from the second hinge joint 8.

Figure 3:
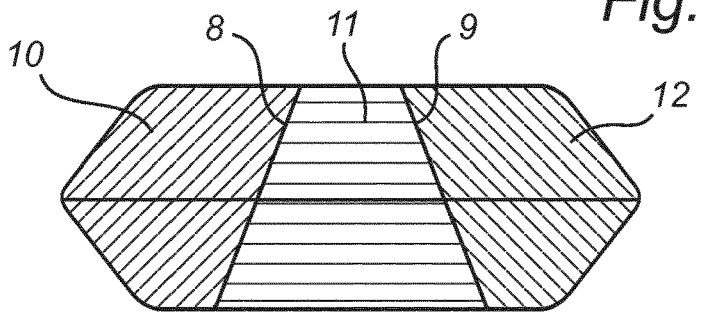
FIG. 3 is a schematic plan view illustrating a first end region, an intermediate region and a second end region of the opening device shown in FIG. 1.

The second and third hinge joints 8, 9 divide the thin-walled body 2 into regions: a first end region 10 comprising a first portion of the first section 6 and a first portion of the second section 7; an intermediate region 11 comprising a second portion of the first section 6 and a second portion of the second section 7; and a second end region 12 comprising a third portion of the first section 6 and a third portion of the second section 7. The second hinge joint 8 is arranged between the first end region 10 and the intermediate region 11; and the third hinge joint 9 is arranged between the second end region 12 and the intermediate region 11. The first end region 10, the intermediate region 11 and the second end region 12 are schematically shown in FIG. 3, to which reference now also is made.

In the shown embodiment, the second hinge joint 8 and the third hinge joint 9 extend in a non-parallel manner. More specifically, the second and third hinge joints 8, 9 extend such that the intermediate region 11 of the thin-walled body 2 exhibits a form of a truncated isosceles triangle. It should however be appreciated that the second and third hinge joints 8, 9 may extend in other manners and thereby define other shapes of the intermediate region 11.

The second and third hinge joint 8, 9 may each be provided as a u- or v-shaped groove formed in the front surface 4 of the thin-walled body 2.

The first end region 10, the intermediate region 11 and the second end region 12 are foldable relative to each other, i.e. to an adjacent region, by means of the second and third hinge joint 8, 9.

Figure 4:
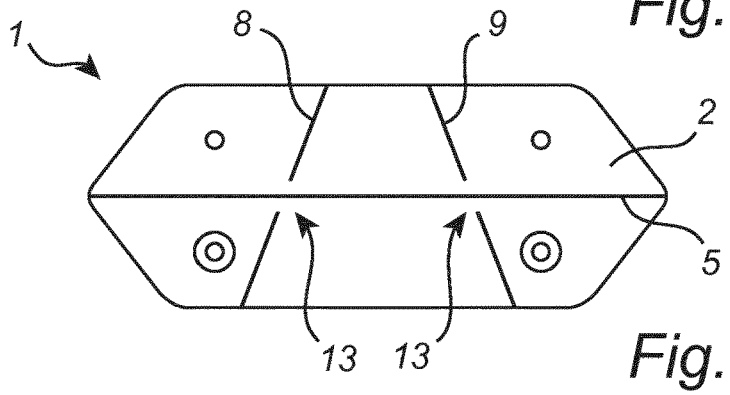
FIG. 4 is a plan view illustrating an alternative embodiment of a resealable opening device in accordance with the present invention.

According to an alternative embodiment which is schematically illustrated in FIG. 4, the second and third hinge joint 8, 9 may each extend along the second P2 and third P3 direction, respectively, with an interruption indicated at 13 when crossing the first hinge joint 5.

Figure 5:
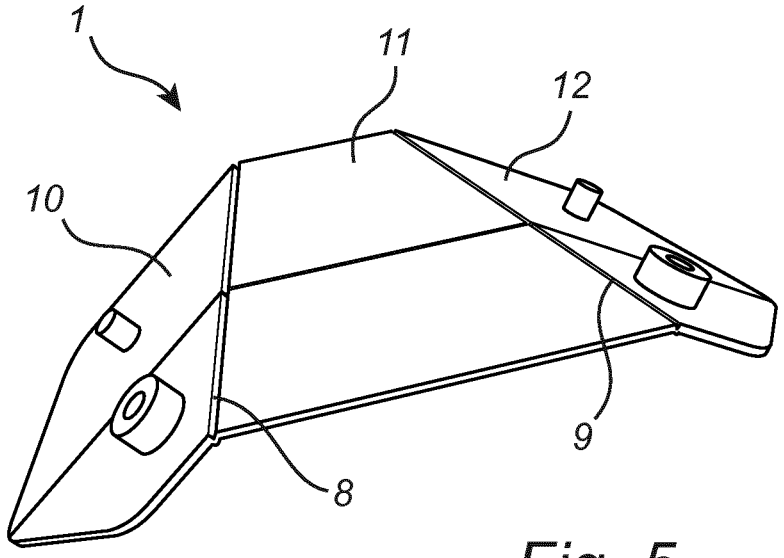
FIG. 5 is a perspective view illustrating the opening device shown in FIG. 1 in a dispensing position.

The inventive resealable opening device 1 is shown in FIG. 5 with its first end region 10, intermediate region 11 and second end region 12 folded relative each other about the second and third hinge joints 8, 9. In the figure, the resealable opening device 1 is shown in a state representing a dispensing position.

The embodiment of the resealable opening device shown in FIG. 1 further comprises a locking member 14.

The locking member 14 is arranged for locking the first section 6 to the second section 7 when the first and second sections 6, 7 are folded towards each other about the first hinge joint 5.

In the shown embodiment, the locking member 14 comprises two locks, each lock comprising a male member 17 in the form of a protrusion arranged on the front surface 4 in the first section 6 of the thin-walled body 2, and a female member 18 in the form of a protrusion provided with a hole 20 arranged on the front surface 4 in the second section 7 of the thin-walled body 2. By folding the first and second sections 6, 7 towards each other about the first hinge joint 5, the male member 16 may be received by the female member 18, preferably by a snap-fit action, and thereby releasable secure the resealable opening device 1 in the folded state.

In the shown embodiment, the locks of the locking member are formed integrally with the thin-walled body. It should be realized however that the locking member may be designed in other ways.

Figure 6:
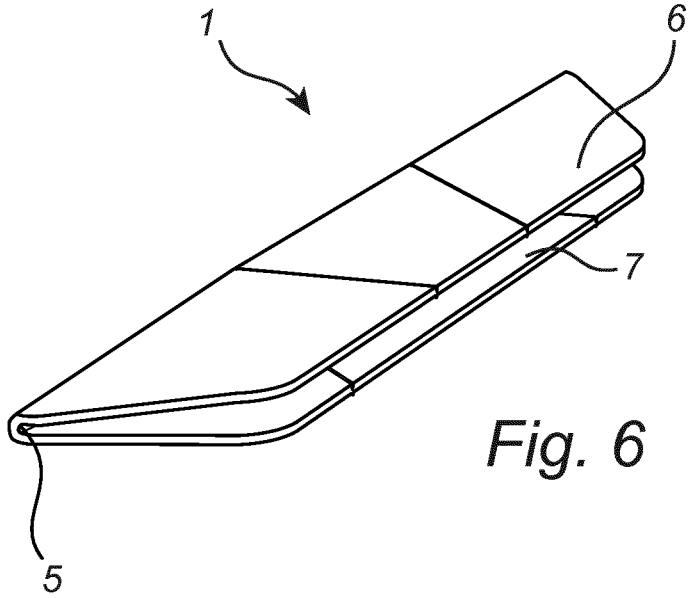
FIG. 6 is a perspective view illustrating the opening device shown in FIG. 1 in a sealing position.

In FIG. 6, the inventive resealable opening device 1 is shown folded about the first hinge joint 5 such that the first and second sections 6, 7 of the thin-walled body 2 are folded towards each other and releasable secured in the folded state by means of the locking member 14. In the figure, the resealable opening device 1 is shown in a state representing a sealing position.

The shown embodiment of the inventive resealable opening device 1 is of a bistable nature meaning that the thin-walled body 2 may not be folded about the first hinge joint 5 when the opening device 1 is maneuvered to its dispensing position, and correspondingly that the thin-walled body 2 may not be folded about the second and third hinge joints 8, 9 when the opening device 1 is maneuvered to its sealing position.

The inventive resealable opening device 1 allows resealing of a flexible package, and the opening device 1 will be described below with reference to a first embodiment of an inventive package 21 according to FIG. 7*a*-7*d*, to which reference now is made.

The flexible package 21 is of the collapsing type, also referred to as a stand-up pouch. This type of package 21 is suitable for liquid products and, as shown in the figures, may comprise a gas-filled handle 22.

An inventive resealable opening device 1 of the type which has been described above with reference to FIG. 1 is applied to the package 21 in a dispensing portion 23 of the package 21, which dispensing portion 23 is formed by two opposing side walls 24 of the flexible package 21 in an upper corner of the same.

The dispensing portion 23 of the flexible package 21 comprises in the unopened state of the package 21 an end tab 25, which for initial opening of the package 21 is separable from the package by detachment along a separation line 26 in order to form an opening. The package 21 is shown in its unopened state in FIG. 7*a*.

The thin-walled body 2 of the resealable opening device 1 is disposed on one of the said opposing side walls 24 adjacent to the end tab 25 of the dispensing portion 23, and, more precisely, is disposed on that side of the separation line 26 situated opposite the end tab 25, adjacent to and parallel with this same separation line 26. The first hinge joint 5 is arranged such that it extends in parallel with an opening formed by removal of the end tab 25, and the first hinge joint 5 thus extends transversely to a dispensing direction P4 of the package 21.

The separation line 26 may be configured as an initiation for facilitating detachment of the end tab 25 from the package 21. The initiation may comprise treated and untreated portions. The treated portions may be configured as weakenings, perforations or the like. The separation line 26 may alternatively be configured as a marking or be constituted by an un-marked intended line of separation.

The resealable opening device 1 may be applied to the package 21 by the use of an adhesive or by a heat-sealing process, or by some other suitable process. The back surface 3 of the resealable opening device 1 may comprise an adhesive layer in order to facilitate application. The adhesive layer may be of the type which is activated by heating.

By virtue of the fact that the opening device 1 may be produced separately from the package 21, production of preformed packages which can be distributed in roll form to a filling plant, such as a dairy, is allowed. Such a roll of preformed packages may then be used in a filling machine to produce filled packages. The inventive resealable opening 1 device may in this case be attached to the package in the filling machine. The opening device 1 may be attached to the package before, during or after the filling thereof.

Figure 7A:
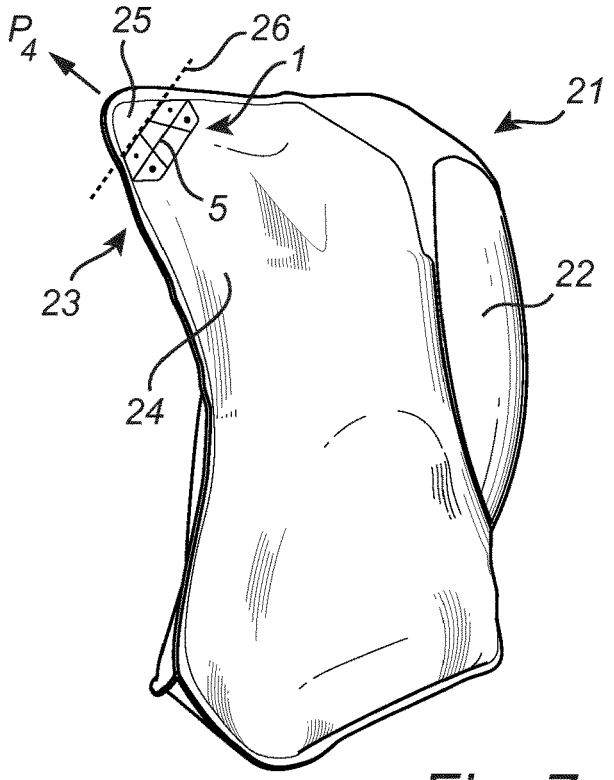
FIG. 7*a-d* is perspective views illustrating an inventive flexible package provided with a resealable opening device maneuvered to different positions.
Figure 7B:
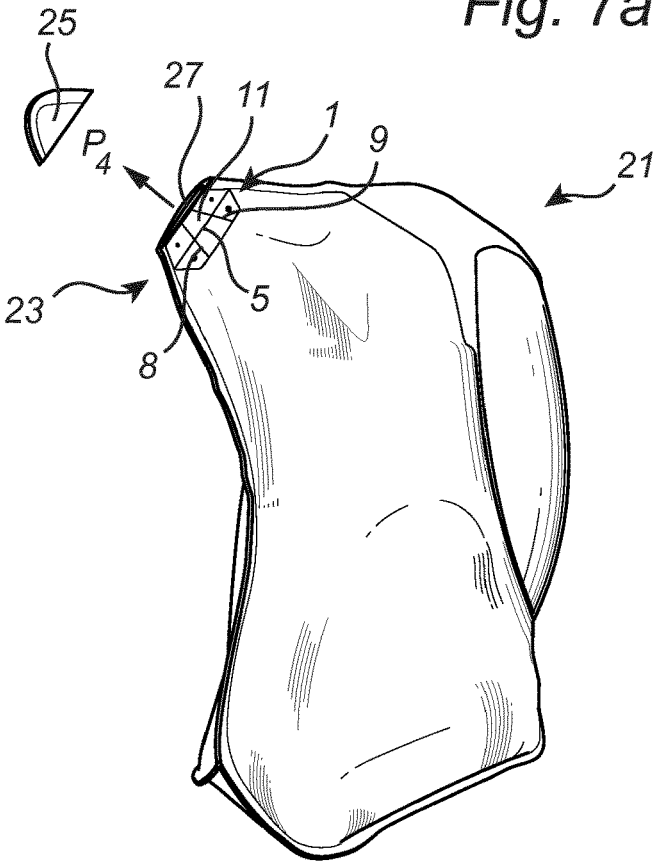

In FIG. 7*b*, the end tab 25 has been separated from the package 21 for initial opening of the same, whereby an opening 27 is formed in the dispensing portion 23, which opening 27 allows contents housed in the package 21 to be dispensed. As can be seen from the figure, the resealable opening device 1 is disposed adjacent to the said opening 27 with the first hinge joint 5 extending in parallel with said opening 27 transverse to the dispensing direction P4 of the package 21.

In the shown embodiment, the second and third hinge joints 8, 9 extend in a non-parallel manner such that the intermediate region 11 of the thin-walled body 2 exhibits a form of a truncated triangle with a base side extending in parallel with a top side. The top side of the truncated triangle is arranged in proximity of the opening 27, i.e. the top side is arranged close to the opening 27 while the base side is arranged at a distance from the opening 27.

In the figure, the resealable opening device 1 is illustrated in the basic position, i.e. the thin-walled body 2 is not folded about any of the hinge joints 5, 8, 9.

Figure 7C:
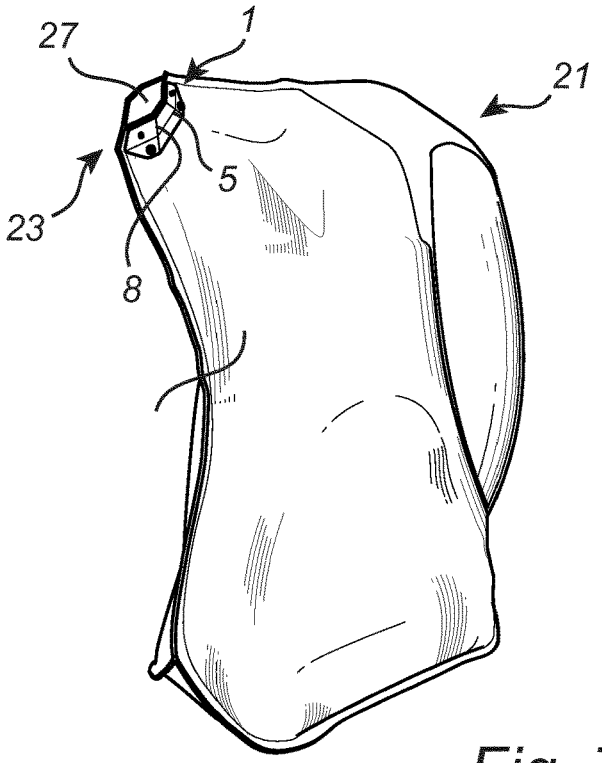

In FIG. 7*c*, the package 21 is illustrated in an opened-up state. The resealable opening device 1 has here been maneuvered from the basic position into the dispensing position by folding the thin-walled body 2 about the second and third hinge joints 8, 9. The maneuvering is expediently realized by the user, with a thumb and index finger grip, pressing the two opposing short sides of the opening device 1 one against the other such that folding takes place about the second and third hinge joints 8, 9. By virtue of the fact that the resealable opening device 1 is disposed on one side wall 24 of the package 21, a part of this first side wall 24 will accompany the opening device 1 during folding about the second and third hinge joints 8, 9, and will be separated from the second side wall 24, which can be made to bulge in the opposite direction. From FIG. 7*c*, it can be seen how the opening 27 in the dispensing portion 23 is opened up and acquires a well-defined dispense area when the resealable opening device 1 assumes the said dispensing position.

It will be appreciated that the dispensing position does not represent an exactly defined position, but is constituted by a position which can vary from one time to another. One of the purposes of the dispensing position is to achieve a dispense area for the opening 27 in the dispensing portion 23. It will also be appreciated that the opening device may able to assume and maintain the dispensing position in response to a force load. This force load can be exerted by the product housed in the package, e.g. in connection with the performance of a pouring motion when the product reaches the dispensing portion 23 of the package 21.

Due to the bistable nature of the resealable opening device 1, folding of the thin-walled body 2 about the first hinge joint 5 is not possible as long as the opening device 1 is in the dispensing position, i.e. the thin-walled body 2 is folded about the second and the third hinge joints 8, 9.

Figure 7D:
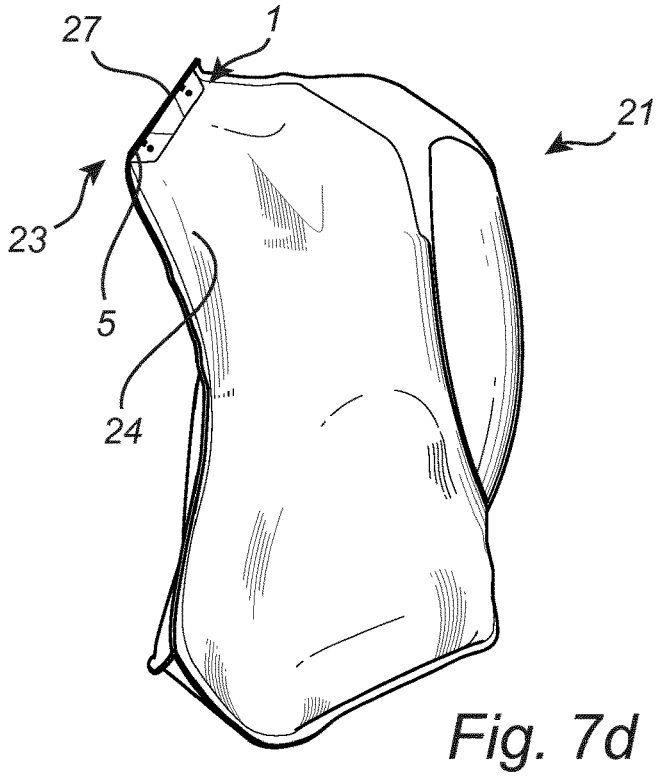

In FIG. 7*d*, the opened package 21 is illustrated about to be resealed. In order to reseal the package 21, the resealable opening device 1 is arranged in its basic position and thin-walled body 2 is then folded about the first hinge joint 5 such that the first and second section 6, 7 of the thin-walled body 2 is folded towards each other until the locks 15 of the locking member 14 is activated constituting the sealing position of the opening device 1.

Since the resealable opening device 1 is disposed on one side wall 24 of the package 21, a part of this first side wall 24 will be folded, together with the opening device 1, in the course of the folding about the first hinge joint 5 and will thus also drag with it a part of the second side wall 24. Consequently, maneuvering of the thin-walled body 2 of the opening device 1 from the basic position into the sealing position causes an end section comprising the said opening 27 in the dispensing portion 23 to be bent over, with the result that the package 21 is resealed. In FIG. 7*d*, the thin-walled body 2 is only partly folded about the first hinge joint 5, i.e. the opening device 1 has not yet reached its sealing position.

As has been described above, the resealable opening device 1 is able to assume the dispensing position in response to a force load. This force load can be exerted by the product housed in the package 21, for instance in connection with the performance of a pouring motion when the product reaches the dispensing portion 23 of the package 21.

The dispensing position of the resealable opening device 1 is enabled by the provision of the second and the third hinge joint 8, 9, and due to the fact that inventive resealable opening device 1 comprises two hinge joints 8, 9 extending in directions P2, P3 crossing the first hinge joint 5 and dividing the thin-walled body 2 into an first end region 10, an intermediate region 11 and a second end region 12, the opening device 1 is able to adapt to a outwardly bulging shape change of the flexible wall 24 of the package 21. Thus, if the package 21 in its un-opened state is placed in a position lying down, such that the contents of the package 21 enters the head space of the package 21, and even more if another package is placed on top of the package 21 lying down, this will cause the dispensing portion 23 of the package 21 to be filled with contents causing the flexible walls 24 defining said dispensing portion 23 to bulge outward, as can be seen in FIG. 8 to which reference now is made.

Such a outwardly bulging shape change of the flexible wall 23 on which the opening device 1 is attach, will result in that the opening device 1 is maneuvered to its dispensing position and thus in that the opening device 1 adapts its shape to the outwardly bulging shape change of the flexible wall 24. This in turn will result in a relief in the stress exerted on the adhesive attaching the opening device 1 to the package 21, thus reducing the risk of the opening device 1 to partly or entirely come loose from the package 21. Consequently, the inventive resealable opening device 1 is suitable for flexible packages 1 which are distributed placed lying down in boxes or crates.

Figure 8:
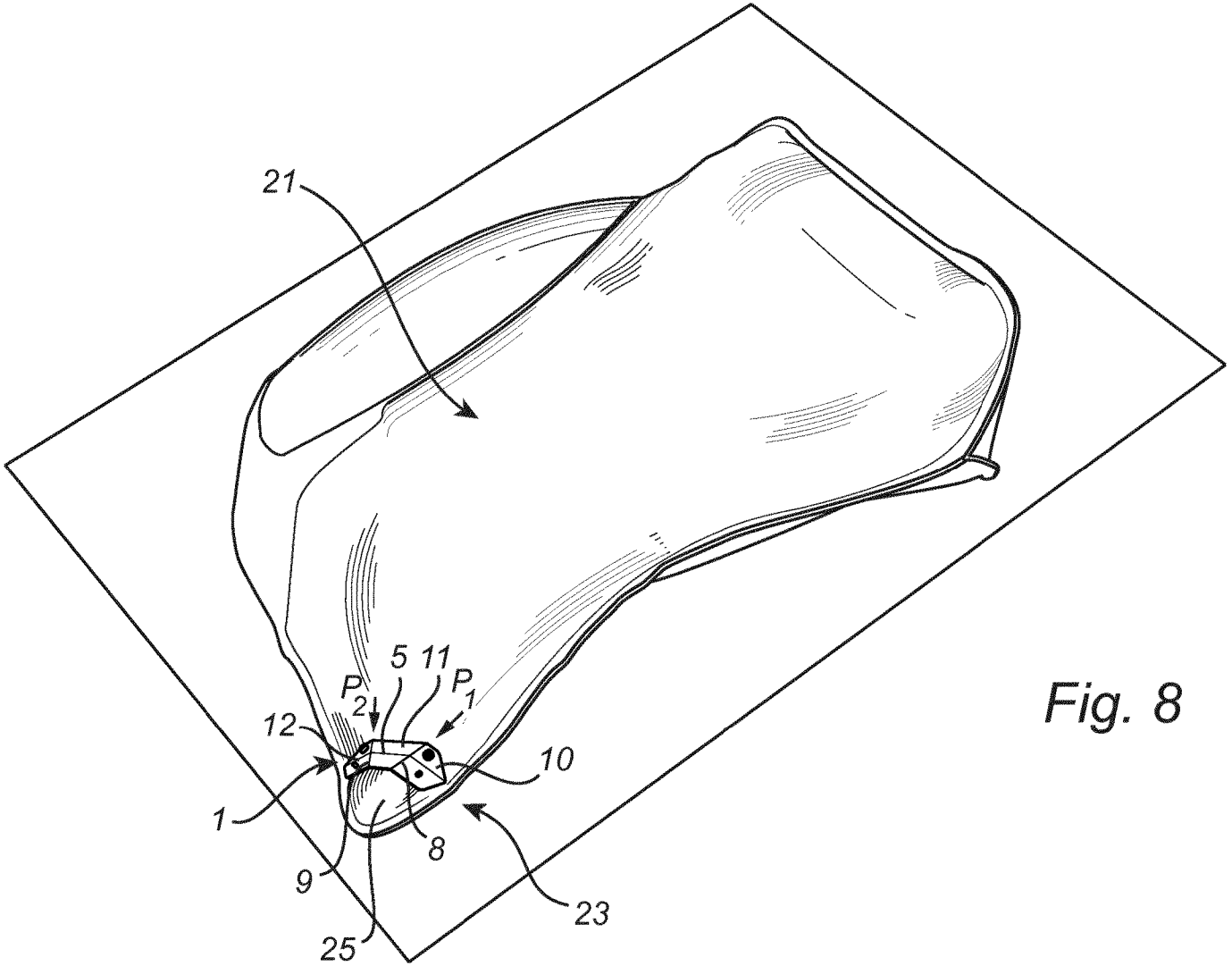
FIG. 8 is a perspective view illustrating an inventive flexible package in an un-opened stat and provided with a resealable opening device according to the invention, the package being placed in a position lying down.

As evident from FIG. 8, the dispensing portion 23 of the package 1 has a tapering shape in direction towards the end tab 25. The fact that the second and third hinge joints 8, 9 extend in a non-parallel manner such that the intermediate region 11 has a form of a truncated triangle with the top side in proximity to the end tab 25 enables the inventive opening device 1 to efficiently adapt to the outwardly bulging shape change of the sidewall 24.

The truncated triangle form of the intermediate region 11 of the thin-walled body 2 has also proven to be advantageous in the opened state of the package 21 when performing a pouring motion, since the opening device 1 when maneuvered to its dispensing position will assist in directing the flow of product dispensed through the opening 27 of the package 21.

As previously has been mentioned, the first hinge joint 5 may be provided as a w-shaped groove in the back surface 3 of the thin-walled body 2. Thus, a ridge will be formed when the opening device 1 is maneuvered to its sealing position, against which ridge the flexible walls 24 of the package 21 is pressed, which insures a reliable sealing of the package 21. According to the embodiment of the invention previously described with reference to FIG. 4, the second and third hinge joints 8, 9 may be provided such that they extend along the second P2 and third P3 direction, respectively, with an interruption 13 when crossing the first hinge joint 5. Hereby the ridge of the w-shaped groove is uninterrupted, resulting in maintained integrity of the ridge and thus provision of a more reliable seal in the sealing position of the opening device 1.

It will be appreciated that the present invention is not limited to the embodiments shown. Several modifications and variations are thus conceivable within the scope of the invention which thus is exclusively defined by the appended claims.

The invention claimed is:

1. A resealable opening device for a flexible package of collapsible type having a compartment defined by flexible walls, comprising a thin-walled body having a back surface attachable on one of the flexible walls of the package in a dispensing portion of the package, a first hinge joint extending in a first direction and connecting a first section of the thin-walled body with a second section of the thin-walled body, the thin-wall body being intended to be arranged such that the first hinge joint is arranged transversely to a dispensing direction of the package, and a second hinge joint extending in a second direction crossing the first hinge joint, wherein a locking member is arranged for locking the first section to the second section when the first and second sections are folded towards each other about the first hinge joint, characterized in that the thin-walled body is provided with a third hinge joint extending in a third direction crossing the first hinge joint and arranged at a distance from the second hinge joint, wherein the thin-walled body comprises a first end region including a first portion of the first section and a first portion of the second section, an intermediate region including a second portion of the first section and a second portion of the second section, and a second end region including a third portion of the first section and a third portion of the second section, wherein the second hinge joint is arranged between the first end region and the intermediate region; and the third hinge joint is arranged between the second end region and the intermediate region, wherein the second hinge joint and the third hinge joint extend in a non-parallel manner giving the intermediate region of the thin-walled body a form of a truncated triangle, and wherein the first end region, the intermediate region and the second end region are foldable relative to each other by means of the second and third hinge joints such that the thin-walled body is adaptable to an outwardly bulging shape change of the flexible wall on which the device is intended to be attached.

2. The resealable opening device according to claim 1, wherein the second and third hinge joint each is provided as a v-shaped groove formed in a front surface of the thin-walled body.

3. The resealable opening device according to claim 1, wherein the second and third hinge joint each extends along the second and third direction, respectively, with an interruption when crossing the first hinge joint.

4. The resealable opening device according to claim 1, wherein the first hinge joint is provided as a w-shaped groove formed in the back surface of the thin-walled body.

5. The resealable opening device according to claim 1, wherein the locking member comprised a male element arranged on the first section of the thin-walled body and a female element arranged on the second section of the thin-walled body.

6. The resealable opening device according to claim 1, wherein the locking member is formed integrally with the thin walled body.

7. The resealable opening device according to claim 1, wherein the thin-walled body is made of PET.

8. A flexible package having a dispensing portion defined by two flexible side walls, comprising a resealable opening device claim 1 disposed on one of the side walls in the dispensing portion adjacent to an opening, formed upon initial opening of the package, for opening and closing thereof, wherein the first hinge joint extends in parallel with the opening, and wherein the second hinge joint and the third hinge joint extend in a non-parallel manner giving the intermediate region of the thin-walled body a form of a truncated triangle, a top of which being arranged in proximity to the opening.

* * * * *